United States Patent [19]

Paulshus et al.

[11] Patent Number: 4,940,362

[45] Date of Patent: Jul. 10, 1990

[54] PACKING MEANS FOR A FLEXIBLE TENSION LEG IN A TENSION LEG PLATFORM

[76] Inventors: Bjorn Paulshus, Slengasen 7, 2020 Skedsmo, Norway; Phil Hawley, Minwear Crowthrone Farm, Crowthrone, Berks, England

[21] Appl. No.: 372,053

[22] Filed: Jun. 27, 1989

[30] Foreign Application Priority Data

Jun. 27, 1988 [NO] Norway ..... 882846

[51] Int. Cl.[5] ..... E02D 5/74

[52] U.S. Cl. ..... 405/224; 403/322; 405/195; 114/294

[58] Field of Search ..... 405/224, 225, 203, 216, 405/61, 169, 170; 403/322, 330; 114/365, 293, 294

[56] References Cited

U.S. PATENT DOCUMENTS

| | | | |
|---|---|---|---|
| 3,934,528 | 1/1976 | Horton et al. | 405/224 X |
| 4,171,923 | 10/1979 | Landers | 405/225 |
| 4,183,698 | 1/1980 | Coone | 405/224 X |
| 4,374,630 | 2/1983 | Fraser | 405/195 X |
| 4,516,882 | 5/1985 | Brewer et al. | 405/224 |
| 4,610,570 | 9/1986 | Brockway | 405/169 X |
| 4,797,036 | 1/1989 | Collins et al. | 405/224 |
| 4,838,736 | 6/1989 | Moore | 405/224 |

*Primary Examiner*—Dennis L. Taylor
*Attorney, Agent, or Firm*—Young & Thompson

[57] ABSTRACT

A tension leg platform has a flexible tension leg member comprising upper and lower tension leg elements and a casing within which the upper and lower tension leg elements are flexibly joined. The platform has a vertical shaft wall in which the casing is supported and a first packing which seals between the casing and the shaft wall. Swingable claws releasably interconnect the upper tension leg element to the casing, and a second packing surrounds the upper tension leg element and releasably seals between the upper tension leg element and the shaft wall. The second packing comprises a hollow cylinder with a coupling flange on the lower end thereof, and a coupling flange on the casing. The claws releasably secure together the flanges and are operated by vertical movement of the cylinder.

8 Claims, 3 Drawing Sheets

PACKING MEANS FOR A FLEXIBLE TENSION LEG IN A TENSION LEG PLATFORM

Figure 1:
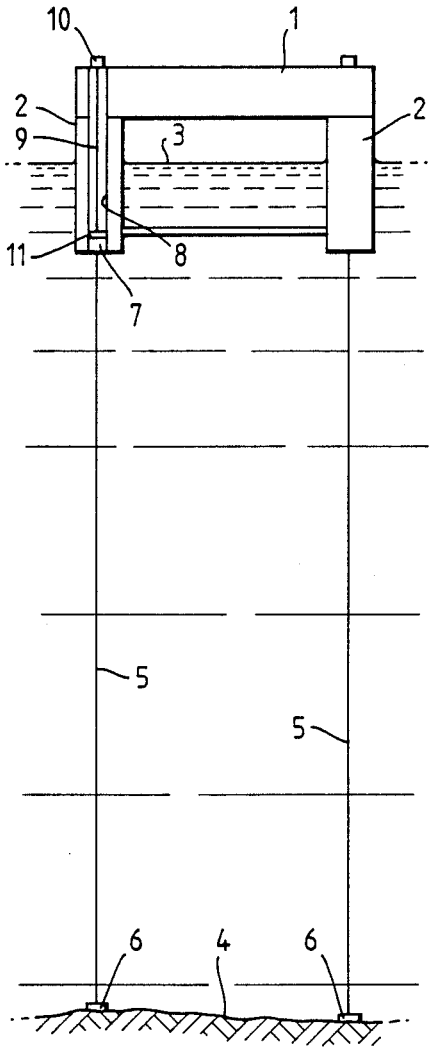

The invention relates to a packing means in connection with a flexible tension leg member in a column of a tension leg platform, which tension leg member comprises a casing in which an upper and a lower tension leg element are connected in a flexible manner, and which is supported by a surrounding shaft wall in said platform column, with said packing means sealing between casing and shaft wall.

More precisely, the invention relates to a packing means in connection with a flexible tension leg member intended for use in a tension leg for a tension leg platform, at the spot where the tension leg from the sea floor meets the platform proper, i.e. the platform column extending down into the water and through which said tension leg continues upwards to a suitable tensioning device above the surface of the water. The tension leg from the sea floor, which has a slightly pendular movement, is by the aid of said flexible member connected with the tension leg extending upwards through the platform column. It is desirable that the column or shaft through which the tension leg extends upwards, is tightened against surrounding sea water. Such a packing means may be provided below said member, so that the latter is dry, or the packing may be provided on top of said member. The special object of such a packing device is to keep sea water out of the column, resulting in reduced platform weight. The present invention relates to a packing means which is provided on top of said member.

According to the invention a packing means as metioned above is provided and is characterized by the fact that it is releasably and sealingly connected with said casing, about the upper tension leg element.

Even though the packing means per se is a stable element which does not require much maintenance in the tension leg platform, it is required that it should be possible to check and/or maintain the packing means, and that, if necessary, it should be possible to replace it. By the aid of the present invention it will be possible to comply with this requirement in a simple and advantageous manner. The packing means being releasably connected with said casing, on top of the flexible member, it is possible, if necessary, to release the entire packing means and take it on deck through the column or shaft. An advantageous and reliable embodiment of the packing means comprises a hollow cylinder with a coupling flange on one end, intended for cooperation with a corresponding coupling flange on the casing. The coupling flanges are provided with oblique rear sides intended for cooperating engagement with coupling claws which are swingably suspended on the inside of the cylinder.

The packing means advantageously comprises a locking ring the outer circumference of which is intended to bear against and lock the coupling claws in a coupled position.

Each coupling claw may advantageously have a dog projecting across the locking ring when the claw is coupld. When the locking ring is released from its engagement with the coupling claws, the locking ring will move towards the dog and thus cause a released state of the claws.

In order to achieve better locking and more reliable release the outer circumference of the locking ring may, furthermore, be slightly conical downwards, whereas the locking claws show correspondingly oblique rear sides which cooperate with the outer circumference of the locking ring. A flexible member, provided between each coupling claw and the cylinder will also contribute to a desired release.

Figure 2:
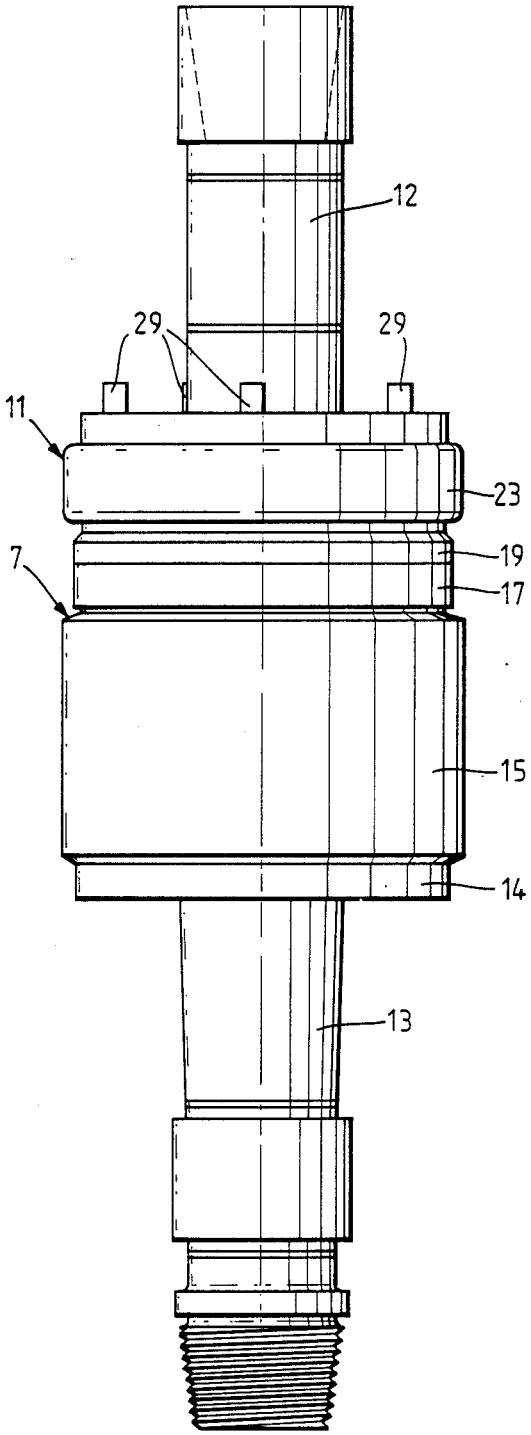
Figure 3:
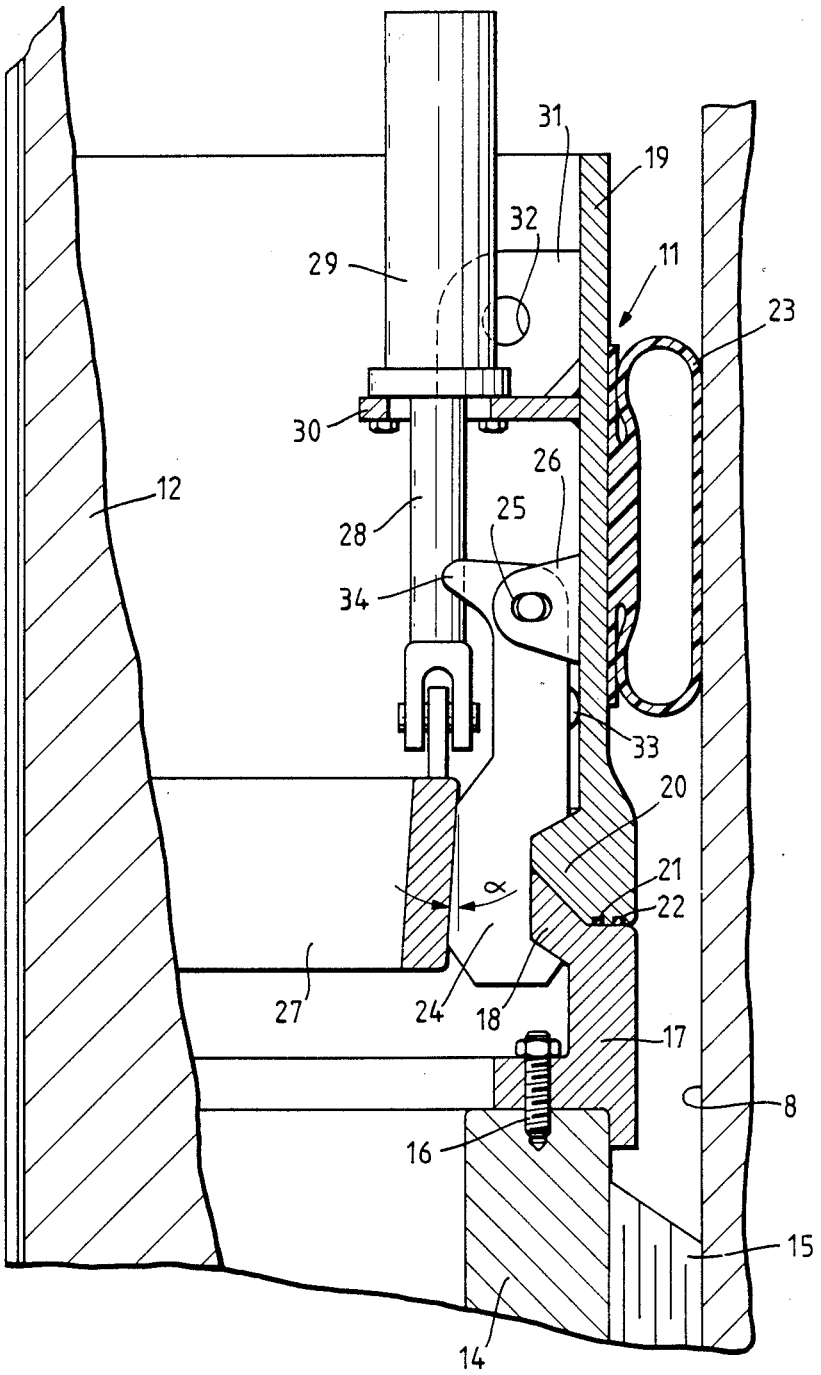
Figure 4:
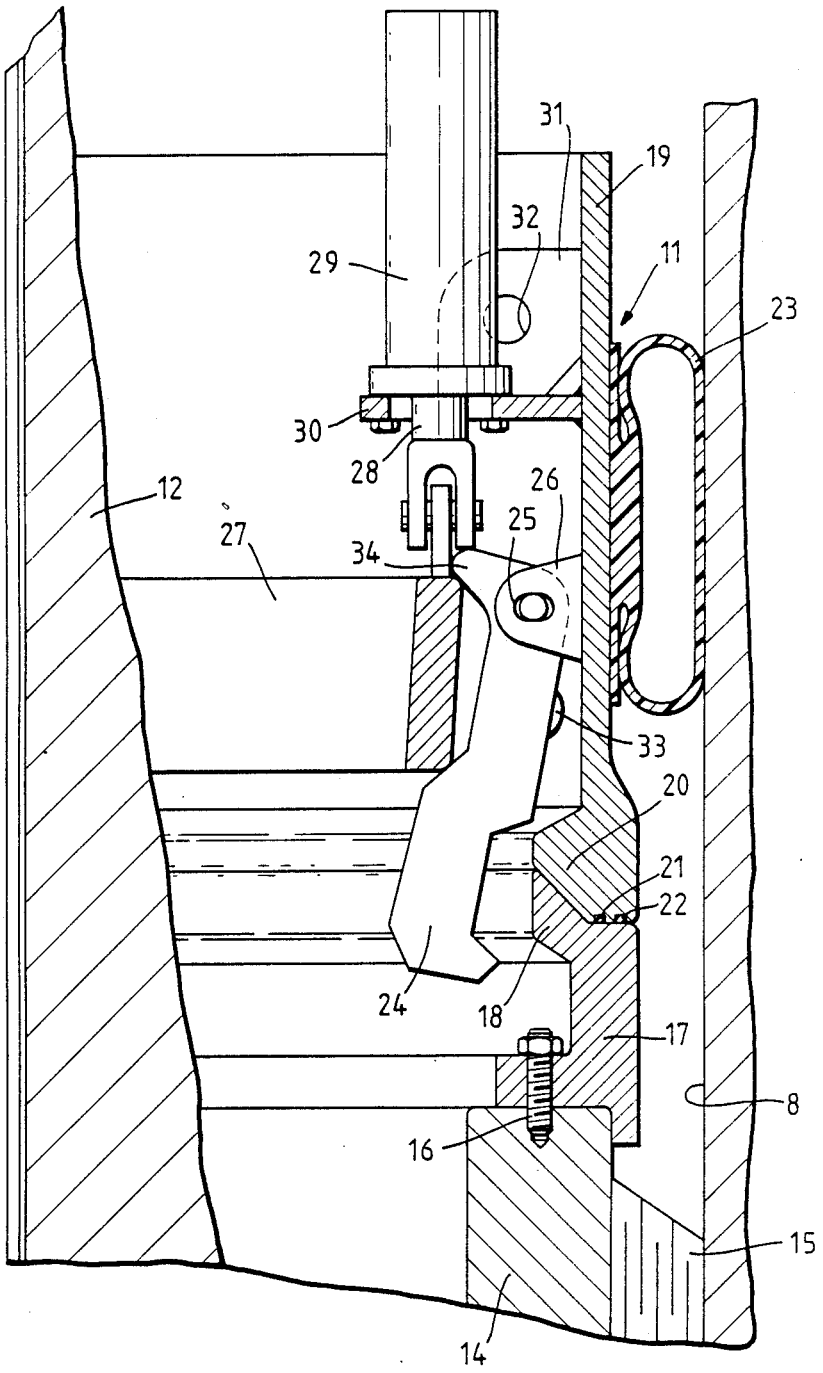

The invention is disclosed in more detail below with reference to the drawings, where FIG. 1 is a diagrammatical view of a tension leg platform where the invention is used, FIG. 2 shows a flexible tension leg member with a connected packing means, FIG. 3 is a section on a larger scale of FIG. 2, in the area of the packing means, and FIG. 4 shows a section corresponding to that of FIG. 3, with a released packing means.

The tension leg platform diagrammatically shown in FIG. 1 comprises a deck 1, and a number of columns 2. Columns 2, as shown, extend down through the water surface 3 and for a distance into the water. The platform is anchored to the sea floor 4 by the aid of tension legs 5 extending from anchoring foundations 6 on the sea floor up to a respective flexible tension leg member 7. In the drawing only one such tension leg member 7 is shown, in the platform column on the left hand side in FIG. 1. Tension leg member 7 is fitted into shaft 8 in column 2 and is supported against the shaft wall to transmit transverse forces. From member 7 the tension leg extends further upwards, by the aid of an extension 9 to a suitable tensioning device 10 above the water surface.

Flexible tension leg member 7 is connected with a packing means 11 which seals off shaft 8 against the surrounding sea water. The chamber in shaft 8, above member 7 can, thus, be pumped free of water and be kept dry.

Each tension leg 5 (each column 2 may comprise a plurality of parallel tension legs) is built like a drill string, i.e. the tension leg is built from pipe lengths or tension leg elements which are screwed together. Two such tension leg elements 12 and 13 meet in a casing 14 and are joined there in a known manner utilizing one or a number of elastomeric bearing members which permit relative swinging movement between tension leg element 13, which forms part of tension dleg 5 shown in FIG. 1, and upper tension leg element 12, which forms part of extension 9 of the tension leg, extending up through shaft 8 in column 2 of the tension leg platform.

Casing 14 is mainly shaped like a hollow cylinder. On its outside it is provided with an elastomeric bearing member 15. This bearing member bears against the internal wall of shaft 8, as shown in FIGS. 3 and 4.

A ring member 17 is secured to upper end of casing 14 by the aid of bolts 16. Ring member 17 is finished by a coupling flange 18.

Packing means 11 mainly comprises a hollow cylinder 19, which at its lower end is provided with a coupling flange 20, intended for cooperation with coupling flange 18 on ring member 17. In two annular grooves in coupling flange 20 packings 21, and 22, respectively are placed. Said packings seal against coupling flange 18. On the outside of cylinder 19 an inflatable annular bellows means 23 is provided to seal against the wall of shaft 8, as shown in FIG. 3. Annular bellows means 23 is inflatable and deflatable, resp. by the aid of compressed air, in a manner not shown in detail.

Coupling flanges 18, 20 are kept in a joined state by the aid of coupling claws 24. Said coupling claws 24, e.g. six coupling claws distributed along the internal circumference of cylinder 19, are designed for cooperating engagement with coupling flanges 18, 20 with the claws bearing against the oblique rear sides of the coupling flanges. Each coupling claw 24 is pivotally mounted in an elongated hole 25 which is provided in a bracket 26 that is secured to the internal wall of cylinder 19.

FIG. 3 shows how the coupling claws (only one coupling claw is illustrated) are kept in a coupled state by the aid of a locking ring 27. Said locking ring 27 is suspended from a plurality of piston rods 28 which are part of respective operating cylinders 29. In FIGS. 3 and 4 such an operating cylinder 29 is shown to be mounted on a bracket 30 which is secured to the inner wall of cylinder 19. Bracket 30 is reinforced by a lug 31 which is welded to bracket 30 and provided with a grip opening 32.

Each coupling claw 24 is provided with a resilient member 33 which is urged towards the inner wall of cylinder 19 when locking claws 24 are in a locking position. Furthermore, each coupling claw 24 has a dog 34. Said dog 34 projects inwards over locking ring 27.

FIG. 3 shows the coupling claws in a locked positon, i.e. with a locking grip across cooperating coupling flanges 18 and 20. Locking claws 24 are secured by the aid of locking ring 27 in a locked position. When it is desired to release packing means 11, annular bellows means 23 is deflated and locking ring 27 is raised, as shown in FIG. 4. This is done by the aid of operating cylinders 29 and associated piston rods 28. The resilient member 33 will now contribute to push locking claws 24 inwards. Locking ring 27 will also move towards dogs 34 and consequently ensure that locking claws 24 swing as shown in FIG. 4. Now, the entire packing means 11 can be pulled up, e.g. by the aid of ropes which are connected with openings 32 in respective lugs 31. After repair or replacement, if desired, the packing means may be lowered again in shaft 8, in place on coupling flange 18, and locking is then achieved by running down locking ring 27 by the aid of operating cylinders 29 to the position as shown in FIG. 3. Annular bellows means 23 is inflated and will bear sealingly against the wall in shaft 8. Then water may be pumped out to empty columns 2 of the platform.

As especially shown in FIG. 3, locking ring 27 is slightly conical downwards, and the rear side of the locking claws is correspondingly oblique. In this manner an advantageous wedge effect is achieved, as well as advantageous release for uncoupling. A suitable angle with the vertical may, e.g. be 3°–4° in this case. In FIG. 3 said angle is designated $\alpha$.

Having described our invention, we claim:

1. In a tension leg platform having a flexible tension leg member comprising upper and lower tension leg elements and a casing within which said upper and lower tension leg elements are flexibly joined, the platform having a vertical shaft wall in which said casing is supported and bearing means between said casing and said shaft wall; the improvement comprising means releasably interconnecting said upper tension leg element to said casing, and packing means surrounding said upper tension leg element and releasably sealing between said upper tension leg element and said shaft wall.

2. Structure as claimed in claim 1, said packing means comprising a hollow cylinder with a coupling flange on the lower end thereof, a coupling flange on said casing, and said releasable securing means comprising means releasably securing together said flanges.

3. Structure as claimed in claim 2, said flanges having oblique rear surfaces that engage with each other in mating relationship.

4. Structure as claimed in claim 2, and coupling claws carried by said cylinder inside said cylinder for releasably securing together said flanges.

5. Structure as claimed in claim 4, and a locking ring vertically movable to bear against and lock said coupling claws in a condition in which said coupling claws releasably secure together said flanges.

6. Structure as claimed in claim 5, each coupling claw having a dog which projects inwardly into the path of said locking ring whereby said locking ring by movement in one direction moves said coupling claws in a direction to secure together said flanges and by movement in the opposite vertical direction engages said dogs to move said claws in a direction to uncouple said flanges.

7. Structure as claimed in claim 5, said locking ring having a conical outer surface, that engages with correspondingly oblique inner surfaces on said claws to move said claws toward said flanges with a cam action.

8. Structure as claimed in claim 4, and a resilient member between each coupling claw and said cylinder.

* * * * *